United States Patent [19]

Marquaire et al.

[11] 4,004,635

[45] Jan. 25, 1977

[54] METHOD FOR CONNECTING A SUBMERGED WELL HEAD TO A PIPE CONSISTING OF STEEL TUBES

[75] Inventors: Roger Andre Marie Marquaire, La Celle St. Cloud; Michel Georges August Curtis, Lyon, both of France; Robert Edouard Schappel, London, England

[73] Assignee: Subsea Equipment Associates Limited, Hamilton, Bermuda

[22] Filed: Apr. 7, 1975 (Under Rule 47)

[21] Appl. No.: 565,908

[30] Foreign Application Priority Data

Apr. 5, 1974 France ..... 74.12174

[52] U.S. Cl. ..... 166/.6; 61/110; 285/18

[51] Int. Cl.² ..... E21B 33/035

[58] Field of Search ..... 166/.6; 285/18, 24, 285/26, 29; 61/72.3

[56] References Cited

UNITED STATES PATENTS

| | | | |
|---|---|---|---|
| 3,682,243 | 8/1972 | Bauer et al. | 166/.6 |
| 3,710,859 | 1/1973 | Hanes et al. | 166/.6 |
| 3,716,100 | 2/1973 | Nelson | 166/.6 |
| 3,835,655 | 9/1974 | Oliver | 61/72.3 |
| 3,866,677 | 2/1975 | Baugh | 166/.6 |
| 3,913,669 | 10/1975 | Brun et al. | 166/.6 |

*Primary Examiner*—James A. Leppink
*Attorney, Agent, or Firm*—Sughrue, Rothwell, Mion, Zinn & Macpeak

[57] ABSTRACT

In the connection of a relatively inflexible pipe to a submerged well head at a depth which may be greater than that to which divers can descend, a pipe placing structure is first locked onto the well head and the pipe is then lowered and automatically connected to the placing structure, a bell housing a sub-assembly including the master valve is next lowered onto the well head and locked thereon by a bearing structure to which the bell is attached. A crew is transferred to the bell to connect the sub-assembly to the well head and to a connector which is automatically connected to the pipe.

12 Claims, 9 Drawing Figures

METHOD FOR CONNECTING A SUBMERGED WELL HEAD TO A PIPE CONSISTING OF STEEL TUBES

Figure 1:
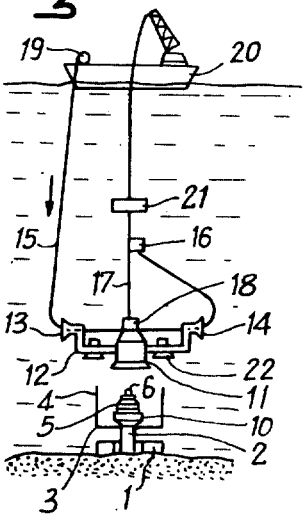

The invention refers to a method of connection of a relatively inflexible outflow pipe, e.g. formed of steel tubes, to an undersea well head especially when the depth of the well head is greater than that which can be reached by diver.

The methods which at present enable connection in water which is not very deep are derived from conventional methods of connection at the surface. In view of the difficulties due to the high pressures existing in deep water known methods intended to perform the connection of outflow pipes without the intervention of divers have to comprise a number of remotely controlled operations using a number of complicated devices and tricky manipulations which render the placing of the pipe a long and costly operation.

According to one aspect of the present invention there is provided a method of connecting a relatively inflexible outflow pipe to a submerged wellhead at a depth which may be greater than that which can be reached by a diver, the method comprising attaching a connector at the surface to the end of said pipe, locking said connector onto a placing structure fixed relative to said wellhead, lowering a diving bell onto said well head, said diving bell being rendered with a bearing structure which is connected to said well head to thus render watertight the volume formed by said well head, said structure and said bell, the orientation of said bell and said bearing structure being chosen as a function of the orientation of said connector relative to said wellhead, attaching to said wellhead a sub-assembly connecting the lining of said wellhead to a master-valve, connecting said sub-assembly to a device for automatic connection to said pipe connector, which automatic connection device is fixed to said bearing structure, and automatically connecting said device to said pipe connector.

In a preferred method of connection of a well to an outflow pipe formed of steel tubes having equipped the wellhead with means for locking thereon a placing structure for the pipe and having equipped the casing with a watertight male connector portion for receiving a bearing structure, one proceeds with the following operations:

a. the placing structure is lowered with the aid of a bearer means until it locks itself onto the locking means on the casing, and is accompanied by a cable which passes through two guide-cones on the placing structure, one of the ends of the cable bearing an attachment means for subsequent connection to the end of the pipe, the other end of the cable being connected to a surface winch.

b. the attachment means on the end of the cable is brought to the surface while continuing to pay out the cable from the winch, in order to connect it at the surface to the end of the outflow pipe. The outflow pipe is lowered progressively while the other end of the cable is rewound on the winch until the attachment means passes through the corresponding guide-cone of the structure automatically locking the end of the steel pipe to the guide-cone at the time as it is automatically released, c. the cable is brought back to the surface while, the outflow pipe is progressively laid by displacing the surface vessel as far as the required place, d. at the surface one of the ends of an electric cable for the installation is connected to a connector passing through a bearing structure, a second connector device passing through the structure being provided with a connector for automatic connection to the end of the steel pipe locked onto the placing structure, the bearing structure being centrally provided with a female connector portion for coupling in a watertight manner to the male connector portion and defining at its periphery an annular bearing surface for receiving a diving bell, e. inside the bell is fixed at least a first sub-assembly for forming a portion of the wellhead and capable of being connected directly to the well lining head, this sub-assembly containing at least one master valve for controlling the flow of the crude produced by the well and at least one tapping for leading the crude to the connector device.

f. the bell is made fast with the bearing structure while it rests on the bearing surface, g. the bell is suspended by means of any guide and remote control device from the end of a riser which is lowered at the same time as the electric cable, h. the female connector portion is automatically locked in a watertight manner onto the said male connector portion at the end of the lowering of the riser.

i. atmospheric pressure is re-established inside the bell, j. the electric cable is laid as the surface vessel moves away.

k. a crew is lowered to the bell by an auxiliary chamber and enters the bell, l. the end of the pipe locked onto the placing structure is automatically connected to the automatic connector device on the bearing structure, the sub-assembly is connected to the wellhead and the electrical circuits and pipework connecting the sub-assembly to the electrical connector and to the outflow pipe are connected up, m. the work-crew is brought back to the surface by the auxiliary chamber and the bell is raised.

Thus just the two descents, of the placing structure followed by laying of the pipe by simple displacement of a conventional pipe laying barge, and of a diving bell including a bearing structure carrying an electric cable, a connector for connection to the end of the steel pipe locked onto the placing structure and a sub-assembly comprising at least one master valve for connection to the connector on the baring structure, are sufficient to ensure, whatever the depth of the undersea wellhead, the connection of the pipe to the well. Not only may the connection be carried out by the usual means: connectors, riser winches, diving bell, but it is carried out in complete safety. Thus, for example the connection of the tap-off pipework proceeding from the sub-assembly of the wellhead, which is installed at atmospheric pressure inside the bell by a crew, presents no difficulty inasmuch as all the heavy elements, such as the bearing structure and wellhead sub-assembly, are mounted and locked either automatically, so far as the bearing structure is concerned, or by means of a handling device with which the bell is equipped, possibly with an automatic guide means, so far as the wellhead sub-assembly is concerned.

It will be observed again that the connections may be carried out even in the event of pounding due to movement of the surface vessel, because the connector at the end of the steel pipe locks itself onto the placing structure by the tension in a cable, and that therefore it is sufficient to employ an anti-pounding device only during the course of the portion of the placing structure and the baring structure, the connections between the well and the electric cable or steel pipe being carried out after locking of the bearing structure.

Besides the foregoing advantage it can be seen that the above method enables satisfactory operation of the production wellhead sub-assembly to be checked by the crew who connect the tap-off pipe to the outflow pipe and effect the electrical connection of the sub-assembly to the electrical connector before the crew return to the surface.

The invention will be more fully understood from the following description of an embodiment thereof, given by way of example only, with reference to the accompanying drawings.

Figure 2:
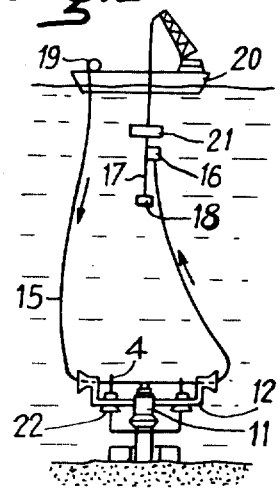
Figure 3:
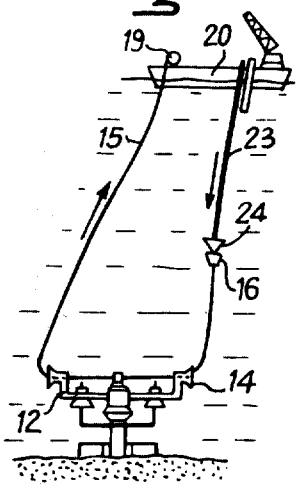
Figure 4:
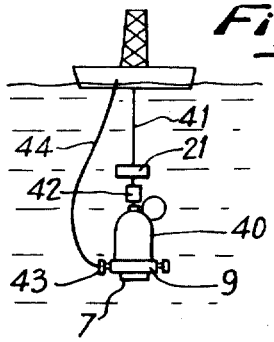
Figure 5:
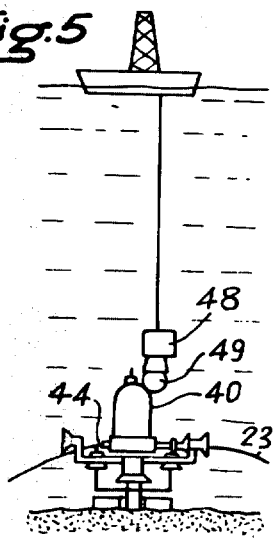
Figure 6:
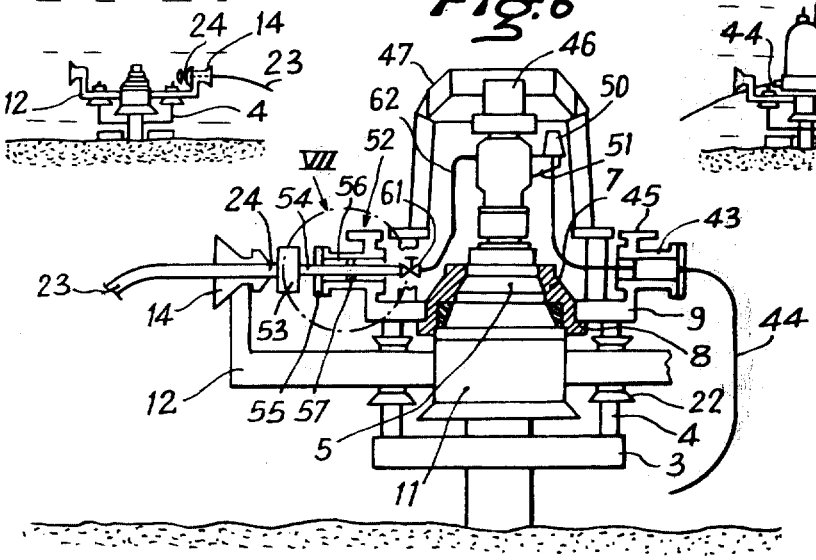
Figure 7:
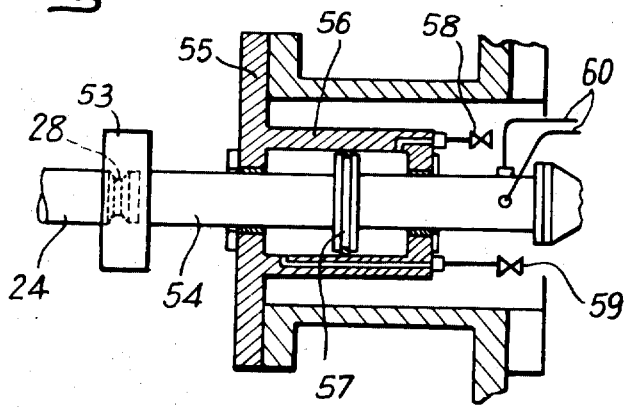
Figure 8:
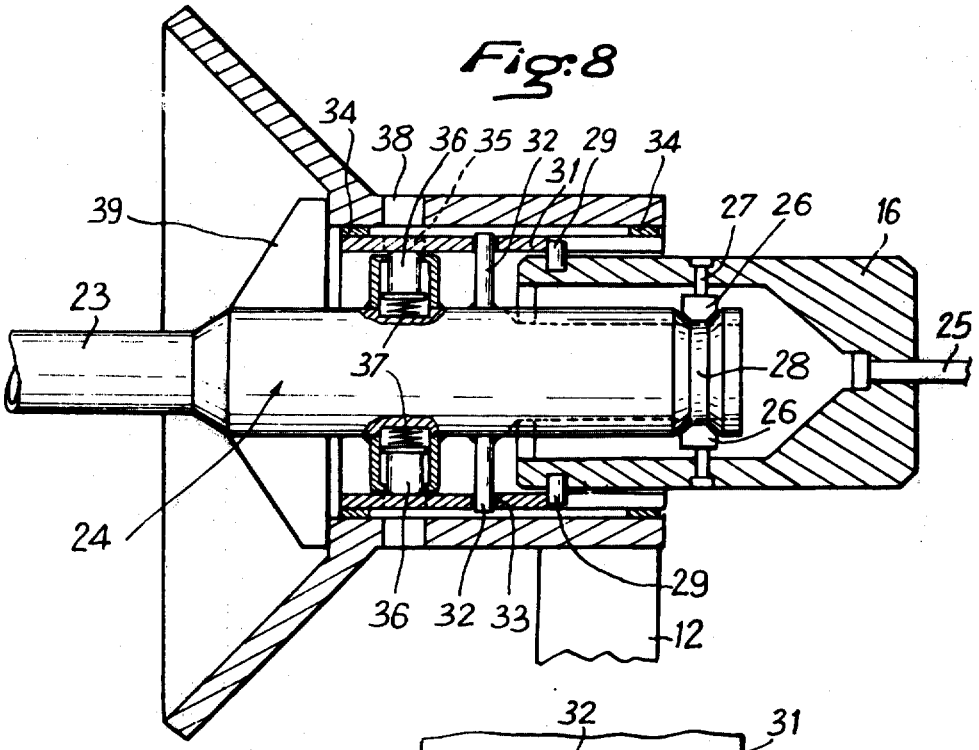
Figure 9:
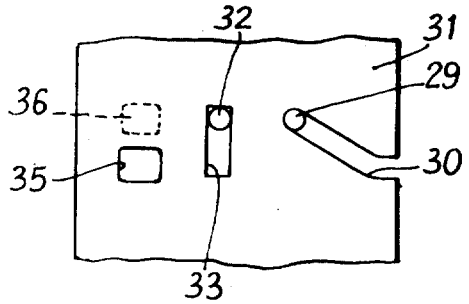

In the drawings:

FIG. 1 is a diagrammatic view of a barge for positioning an outflow pipe placing structure on the wellhead and during the course of lowering of the placing structure:

FIG. 2 is a diagrammatic view of the group after lowering of the placing structure, FIG. 3 is a diagrammatic view during the couse of lowering the pipe, FIG. 4 is a diagrammatic view during the course of lowering the bearing structure of the wellhead sub-assembly, FIG. 5 is a diagrammatic view after lowering of the bearing structure, FIG. 6 is a diagrammatic view of the well after raising of the diving bell, FIG. 7 is a view of a detail of the connection to the pipe, FIG. 8 is a diagrammatic view of the device for locking the end of the steel pipe onto the placing structure, and FIG. 9 is a diagrammatic view of a detail of the device of FIG. 8.

In FIG. 1 a well has been shown with a temporary guide-base 1 surrounding well casing 2 and a conventional base structure 3 provided with any suitable guide means, such for example as columns 4. At the top of the casing, there is the male portion 5 of a connector. This connector portion 5 has the purpose of ensuring external watertightness of the well between the casing 2 and the lining 6 and of serving as a seating for a female connector portion 7, FIGS. 4 and 6, which is fixed by a flange 8 to bearing structure 9. Beneath the connector portion 5 there is a locking means 10 for automatic connection of a connector 11 fast with a placing structure 12. This structure 12 is provided with two guide-cones 13 and 14 through which a cable 15 passes one end of the cable carrying a device 16 for attachment of a connector 24, FIG. 7, on the end of an outflow pipe 23 composed of steel tube. The attachment device 16 is attached during the course of lowering the structure 12 to a handling means 17 guided by a conventional guide and remote control device 21 employing position-finding means, such for example as sonars. At the end of the handling means 17 is a tool 18 supporting the structure 12. The other end of the cable 15 is attached to a winch 19 on the vessel 20, which is operated to pay out the cable 15 during the lowering of the guide device 21 and the structure 12.

The guide device 21 ensures correct presentation of the structure 12 opposite the columns 4, so that at the end of the descent these columns enter vertical guide-cones 22 (FIG. 2) on the structure 12, so that the connector 11 will lock itself automatically onto the locking device 10. As soon as this connection has been effected the handling means 17, to which is hooked the attachment device 16, is brought back to the surface, a portion of the cable 15 being simultaneously paid out by operation of the winch 19.

The device 16 is connected at the surface to connector 24 on the pipe 23 and pipe 23 is then lowered by progressively assembling the steel tubes which compose it by any conventional method. If the guide-cone 14 is orientatable or mounted for pivotal movement on a horizontal axis, the pipe 23 can be lowered vertically to the structure as shown in FIG. 3. Otherwise the barge 20 may be displaced until the attachment device 16 is progressively engaged in the guide-cone 14 under the effect of the drag exerted on the cable 15 by the winch 19.

Locking of the connector 24, FIGS. 3 and 8, at the end of the outflow pipe 23 onto the guide cone 14 on the structure 12 is effected by simply the drag of the cable 15 on the attachment device 16. For this purpose the attachment device 16 is locked to the cable 15 by an attachment portion 25. (FIG. 8) Locking fingers 26 mounted on the device 16 by means of shearpins 27 are engaged in a throat 28 in the connector 24 during assembly at the surface to hold connector 24 relative to device 16. The device 16 includes in addition guide-cams 29 formed, for example, by fingers which are engaged in slots 30 (FIG. 9) in a sleeve 31. The sleeve 31 is locked to the connector 24 by means of attachment tongues 32 passing through slots 33 in the sleeve. An element 34 ensures suitable spacing between the guide cone 14 and the sleeve 31. Openings 35 are also provided in the sleeve 31 with a view to enabling locking of the connector 24 and the guide-cone 14. Latches 36 urged outwardly by springs 37 are retained by the sleeve 31 as long as the latter has not re-rotated about its axis to present an opening 35 opposite a corresponding seating 38 in the guide-cone 14.

When the cable 15 drags on the connector 24 by means of the attachment part 16, the locking fingers 26 communicate this force to the connector 24 until stops 39 engage the base of the cone 14. As soon as the force of traction exceeds a predetermined amount the shearpins 27 yield and the attachment device 16 continues its movement whilst the cams 29 slide in the slots 30 in the sleeve 31. The inner ends of the cams 29 slide in longitudinal grooves in the connector 24 in order to avoid simultaneous rotation of the sleeve 31. and the device 16. The sleeve 31, remaining locked to the connector 24 by the attachment tongues 32 in the transverse slots 33, rotates under the effect of the longitudinal displacement of the cams 29 so that the openings 35 in the sleeve 31 come opposite the latches 36 which, under the action of the springs 37, pass through the openings 35 and engage in the seatings 38, thus locking the guide-cone 14 and the connector 24 together.

As soon as this connection has been effected the vessel 20 e.g. a barge may be moved away in order to finish the placing of the pipe 23 and the connection of its other end at the selected place. After this operation is complete a baring structure 9 is lowered by means of a diving bell 40 suspended from riser 41 by means of a guide and remote control device 21 and a handling tool 42. The structure 9, seen more clearly in FIG. 6, includes an electrical connector 43 which is connected at the surface to an electric cable 44 serving the wellhead. The bell 40 bears against a surface 45 on the structure 9 and contains a sub-assembly 46 and a protective and guide structure 47 for assembly 46.

After lowering of the bell 40 with a determined orientation, which may be ensured by seatings at the bottom of the structure 9 which receive the ends of guide columns 4, and after automatic attachment of the female connector portion 7, which is fixed to the structure 9, to the male connector portion 5, connection between the well head and the pipe 23 proceeds. If the bell 40 does not include a chamber for transfer of a work-crew, an auxiliary chamber 48, FIG. 5 is lowered onto airlock 49.

Joining up of the sub-assembly by the crew is then proceeded with, the bottom portion of the sub-assembly being connected to the lining 6, FIG. 1, as well as joining up of the electrical connector 43 and electrical distributor 50 which in turn is connected to the sub-assembly 46 by connection 51. When there is intention to complete the wellhead with another sub-assembly controlling, for example, the sub-assembly 46 a reference pointer mounted on the protective structure 47 is positioned to indicate the orientation of the sub-assembly 46 with respect to the structure 47.

The structure 9 having been suitably orientated by means of the guide device 21 and the columns 4, the connector 24 on the outflow pipe 23, FIG. 6, locked onto the guide cone 14 of the structure 12, is positioned opposite an automatic connection device 52. This device 52 (FIG. 7) comprises an hydraulic connector 53 carried by a tube 54 which passes through the end 55 of a cylinder 56, the end and cylinder being fixed to the structure 9. A piston 57 fixed to the tube 54 enables the connector 53 to be moved towards the connector 24 when the cylinder 56 is suplied at 58 or enables the connector 53 to be withdrawn by supplying the cylinder at 59. Hydraulic control lines 60 are provided for control of the connector 53. The hydraulic power may be provided by equipment in the bell 40. By connecting auxiliary valve 61 to the sub-assembly 46 by pipework 62 connection of the lining 6 to the outflow pipe 23 is completed.

It will be understood that the bell 40 which rests on the annular bearing surface 45 of the bearing structure 9 may be of a type different from that shown and that this also applies to each of the conventional means employed, such as the guide device 21 which ensures satisfactory presentation of the bell 40 on the axis of the well, the device 42 enabling handling of the bell and the transmission of commands thereto, as well as connector devices 43 and 50. It is for this reason that these means are not described in any detail.

Numerous variants of the above described method may be conceived depending on the particular means employed. By way of example, the bell may include a crew transfer chamber rendering unnecessary the lowering of an auxiliary chamber. Similarly an auxiliary chamber may be employed which is not connected to the surface vessel. As to the male connector portion it may be simplified or even be omitted depending upon the particular arrangement adopted for the head of the casing and lining, only the female connector portion 7 provided with means of fluid tightness and locking onto the casing and lining head being retained on the bearing structure 9 which is also provided with the connector 43 carrying the electric cable 44 and is associated with a structure 12 comprising a guide-cone 14 for automatically receiving the connector 24 at the end of the outflow pipe 23.

What is claimed is:

1. A method of connecting a relatively inflexible outflow pipe to a submerged well head at a depth which may be greater than that which can be reached by a diver, the method comprising the steps of; attaching a pipe connector at the surface to an end of said outflow pipe; locking said pipe connector onto a placing structure fixed relative to said well head; lowering a diving bell onto said well head, said diving bell being provided with a bearing structure which is connected to said well head to thus render watertight the volume formed by said well head, said structure and said bell; the orientation of said bell and said bearing structure being chosen as a function of the orientation of said pipe connector relative to said well head; attaching to said well head a sub-assembly coupled to the lining of said well head; connecting said sub-assembly to a device for automatic connection to said pipe connector, which automatic connection device is fixed to said bearing structure; and automatically connecting said device to said pipe connector.

2. A method as claimed in claim 1, including the steps of; lowering a placing structure for placing said outflow pipe from a surface vessel, said placing structure including means for locking onto the casing of said well head and at least one means of attaching said pipe connector such that said pipe connector will be coupled automatically thereto by tension, wherein said lining is connected manually to said sub-assembly, an electrical distribution circuit of said well is connected to an electrical connector passing through said bearing structure, said electrical connector having been connected at the surface to an electric cable, said sub-assembly is connected to a valve of a pipe connector passing through said bearing structure, said diving-bell is brought back to the surface.

3. A method as claimed in claim 2, wherein said pipe connector is locked to said attachment means by passing a cable through said attachment means, one end of said cable being connected to a winch on a surface vessel and the other end of said cable being connected to said pipe connector connected to said outflow pipe, said pipe being progressively lowered until said pipe connector enters said attachment means on said placing structure and a pull on said cable is thereafter exerted to release said cable from said connector.

4. A method as claimed in claim 3, wherein locking of said pipe connector at the end of said outflow pipe in a guide-cone on said placing structure is obtained by mounting at the surface an attachment device on the end of the cable passing through the said guide-cone on said placing structure by attaching said pipe connector to said attachment device by shearpins, by attaching a stop to said pipe connector preventing its passing through said guide-cone, and shearing of said pins causing displacement of said attachment device relative to said pipe connector to cause locking of said pipe connector onto said guide-cone.

5. A method as claimed in claim 1, wherein connection of said pipe connector when locked to said attachment device of said placing structure and said automatic connection device on said bearing structure is ensured by giving said placing structure and said bearing structure a like orientation such that the axes of the said pipe connector and said automatic connection device coincide.

6. A method as claimed in claim 5, wherein a like orientation of said placing structure and said bearing structure is ensured by guiding them on columns located on a base structure of said well head.

7. A method as claimed in claim 5, wherein said automatic connection device includes a connector which is displaced axially to lock itself onto said pipe connector on the end of said outflow pipe.

8. A method as claimed in claim 7, wherein after lowering and fixing of said diving-bell atmospheric pressure is re-established inside said bell and said automatic connection device connector is displaced by employing hydraulic controls of said bell and by connecting an auxiliary valve, connected to said automatic connection device on the side opposite to said pipe connector, to said sub-assembly.

9. Apparatus for connecting a relatively inflexible outflow pipe to a submerged well head casing comprising; means for guiding and receiving a pipe connector fixed to the end of said outflow pipe; means for locking said means for guiding and receiving onto the well head casing; said guide and receiving means including a portion serving as a stop for limiting passage therethrough of an end of said pipe connector, a conical guide portion and a cylindrical portion, said cylindrical portion including means for locking said pipe connector relative thereto; and means for determining the orientation of said guiding and receiving means with respect to the well head casing.

10. Apparatus as claimed in claim 9, wherein the guide and receiving means is orientatable.

11. Apparatus as claimed in claim 9, including, on the axis of said guiding and receiving means, a displaceable connector for connecting said pipe connector to a sub-assembly of the well, said displaceable connector being mounted at the end of a pipe and being actuatable by a hydraulic jack fast with a structure to be locked onto the well, said latter structure including means for determining its orientation with respect to the well head.

12. Apparatus as claimed in claim 9 including a bearing structure having at its periphery a bearing surface for a diving-bell and on its lateral surface an automatic connector for connecting the sub-assembly of the well to said connector on the pipe end, and an electrical connector connected to an electric cable and means for determining its orientation with respect to the well head.

* * * * *

UNITED STATES PATENT AND TRADEMARK OFFICE

CERTIFICATE OF CORRECTION

PATENT NO. : 4,004,635

DATED : January 25, 1977

INVENTOR(S) : Roger Andre Marie Marquaire et al

It is certified that error appears in the above-identified patent and that said Letters Patent are hereby corrected as shown below:

IN THE SPECIFICATION:

Column 2, line 53, delete "baring" and insert --bearing--.

Column 3, line 8, delete "baring" and insert --bearing--;

line 29, delete "couse" and insert --course--.

Column 4, line 68, delete "baring" and insert --bearing--.

Column 5, line 40, delete "suplied" and insert --supplied--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*